United States Patent [19]

Baggiani

[11] Patent Number: 4,677,919

[45] Date of Patent: Jul. 7, 1987

[54] TRANSFORMABLE LOW DRAWING-ROOM TABLE

[76] Inventor: Giuseppe Baggiani, Via Provinciale Castiglionese, 58043 Castiglione della Pescaia GR, Italy

[21] Appl. No.: 825,931

[22] Filed: Feb. 4, 1986

[30] Foreign Application Priority Data

Feb. 13, 1985 [IT] Italy ..... 47674 A/85

[51] Int. Cl.[4] ..... A47B 57/00

[52] U.S. Cl. ..... 108/63; 108/144

[58] Field of Search ..... 108/11, 19, 67, 63, 108/70, 71, 74, 78, 77, 96, 105, 106, 107, 116, 144, 138

[56] References Cited

U.S. PATENT DOCUMENTS

| | | | |
|---|---|---|---|
| 236,589 | 1/1881 | Hoffmeier | 108/63 |
| 529,140 | 11/1894 | Schnarr | 108/74 |
| 1,009,034 | 11/1911 | Arndt | 108/74 |
| 1,167,905 | 1/1916 | Kreczkowski | 108/63 |
| 1,197,172 | 9/1916 | Baldi | 108/63 |
| 2,599,020 | 6/1952 | Safstrom | 108/144 |
| 2,666,680 | 1/1954 | Alperstein | 108/70 |
| 2,852,325 | 9/1958 | Fosnaugh | 108/63 |
| 3,179,071 | 4/1965 | Johnston | 108/144 |
| 4,566,741 | 1/1986 | Eriksson et al. | 108/138 X |

FOREIGN PATENT DOCUMENTS

| | | | |
|---|---|---|---|
| 2644668 | 4/1978 | Fed. Rep. of Germany | 108/96 |
| 489491 | 7/1938 | United Kingdom | 108/63 |

*Primary Examiner*—Kenneth J. Dorner
*Assistant Examiner*—José V. Chen
*Attorney, Agent, or Firm*—Fleit, Jacobson, Cohn & Price

[57] ABSTRACT

The transformable low drawing-room table of the invention comprises a bearing surface formed by four upper flat rectangular, side by side arranged, elements which are equal to one another, overlapping according to the same direction and suitably hinged on two lower flat rectangular, side by side arranged, elements which are equal to each other and have the same length as the upper flat elements while being each twice the width of one of them.

The assembly of said upper and lower flat elements is supported by a pair of bearing M-shaped members each comprising two outer vertical legs integral with slanting central braces forming a "V" and carrying inside an eccentric sliding guide for support arms of the bearing surface. The slide of the arms upwardly in the oblique direction causes the bearing surface to be raised as well as the lower flat elements to be moved away from each other together with the associated upper flat hinged elements overlapping them to a predetermined extent equal to the width of the upper flat elements.

Engagements are provided to lock the arms in the raised position. Stiffening means are also provided, which are disposed crosswise under the lower flat elements and which comprise telescopic extension means supporting the upper flat elements.

10 Claims, 7 Drawing Figures

TRANSFORMABLE LOW DRAWING-ROOM TABLE

BACKGROUND OF THE INVENTION

The limited area of many town houses as well as holiday houses imposes to take the greatest advantage of the available space.

In particular, it is desirable to use the same room as a dining and drawing room. In this case, a low small table is generally placed near the arm-chairs and/or to the sofa, while a common table is used for dining.

The object of the present invention is to provide a single table which may be used for both and other purposes, i.e. a low drawing-room table the height and area of which can be increased so as to obtain a common table.

SUMMARY OF THE INVENTION

To this end, the drawing-room table according to the invention comrises a bearing surface formed by four upper flat rectangular, side by side arranged, elements which are equal to one another and overlap according to the same direction two lower flat rectangular, side by side arranged, elements which are equal to each other and have the same length as the upper flat elements while being each twice the width of one of them.

The upper outer flat elements are hinged on the lower flat elements along the respective outer longer sides, while the upper inner flat elements are hinged to the lower flat elements along the respective inner longer sides so as to provide an alignment of all the elements in the same plane by suitably moving away from each other the lower flat elements and turning over each upper flat element about the respective hinges connecting them to said lower flat elements.

The assembly of said upper and lower flat elements is supported by a pair of essentially M-shaped bearing members, each comprising two outer vertical legs integral with two slanting central braces forming a "V" and preferably but not necessarily resting on the floor through a suitable supporting base.

Each of the slanting V-arranged braces is provided inside with a groove having the function of guiding a sliding arm integral, at its upper end, with a horizontal bracket supporting the bearing surface of the table, and having the lower end shaped, for example, in the form of a step or the like. Said guiding groove formed in the slanting braces is eccentrically placed in the portion inwardly facing the "V" and leads at its upper end to a widened portion having a shaped bottom for example in the form of a step or the like complementary to the lower end of the arm.

Stiffening means are placed crosswise under the lower flat elements and are provided with telescopic extensions projecting in opposite directions and supporting the upper flat elements when these latter are turned over about the respective hinges connecting them to the lower flat elements.

As an alternative to the stiffening means supporting the upper flat elements in turned over condition and according to an embodiment of the present invention, the horizontal brackets supporting the bearing surface of the table and integral with the upper end of the arms sliding into the slanting braces are hollow so as to contain means to be telescopically extended in opposite directions.

Horizontal stiffening cross-arms parallel to the sides of the table are further provided between the slanting braces and between the M-shaped bearing members.

The low drawing-table according to the invention can be transformed into a table having such an height as to be used, for instance, as a dining table by the following operations.

A lower flat element together with the corresponding overlapping upper flat elements thereto hinged are raised so that the pair of arms supporting said flat elements are caused to slide into the inner guides of the slanting braces, till each shaped lower end of said arms engages the complementary shaped bottom of the widened portion of each inner guide. The telescopic extensions of the stiffening means are drawn out and the upper flat elements are turned over till they come into contact with said telescopic extensions. The raising and the shifting of the lower flat elements outwardly in the oblique direction as well as the doubling of the useful surface of the bearing plane are thus obtained.

The same operations are carried out as far as the second half of the table is concerned so as to provide a solid and safe dining table.

By different operations the low drawing-table according to the invention can also be transformed, for instance, into either a low drawing-table with enlarged bearing surface or shelfs with offset heights or a writing-desk with a seat, etc.

DESCRIPTION OF THE DRAWINGS

These and other features will be apparent from the following detailed description of an embodiment of the transformable table according to the invention, with reference to the accompanying drawings wherein.

DETAILED DESCRIPTION

Figure 1:
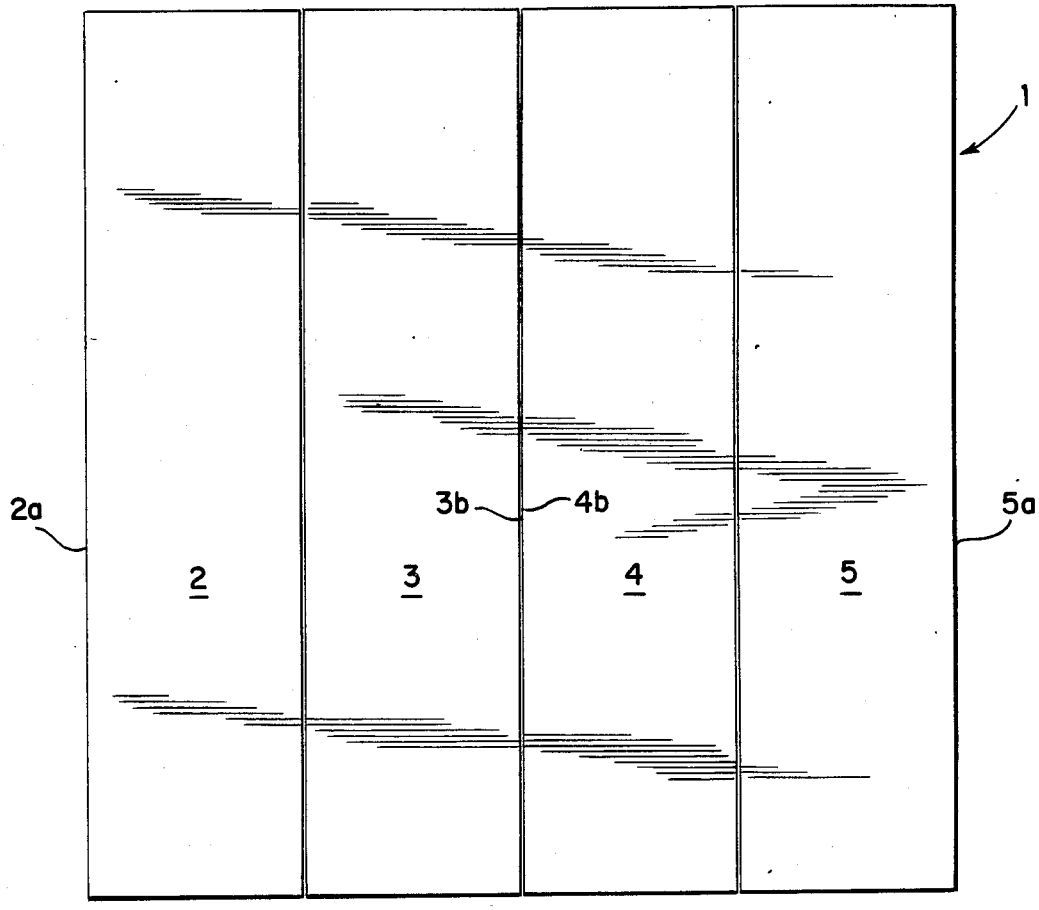
FIG. 1 is a top plan view of the table according to the invention in closed condition.
Figure 2:
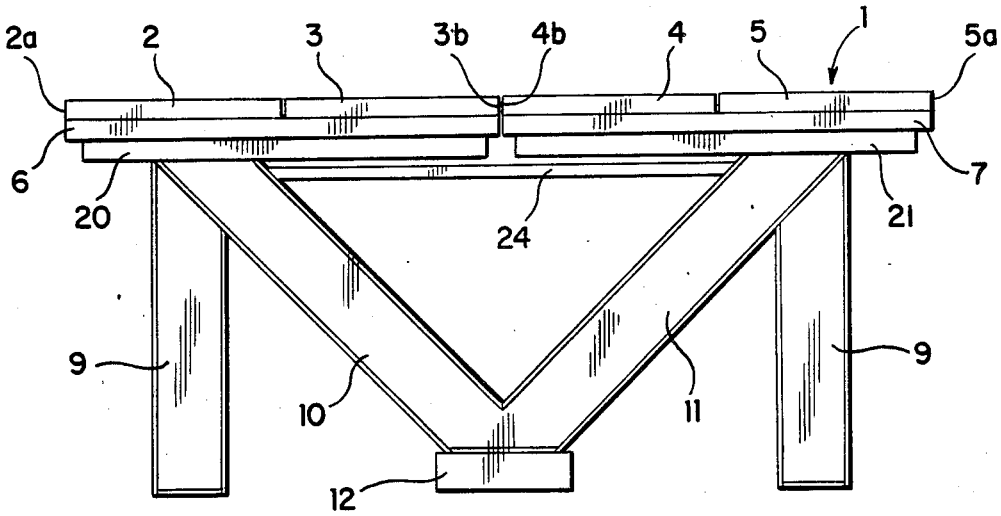
FIG. 2 is a front view of the table in closed condition.

With reference to the FIGS. 1 to 4, the low drawing-room table according to the invention comprises a bearing surface 1 formed by four upper rectangular, side by side arranged, flat elements 2, 3, 4, 5 which are equal to one another and overlap two lower rectangular, side by side arranged, flat elements 6 and 7 which are equal to each other and have the same length as the upper flat elements 2 to 5 while being each twice the width of one of them.

The upper flat element 2 and the upper flat element 5 are connected by hinges 8 placed along the outer longer sides designated by numerals 2*a* and 5*a* to the corresponding outer longer sides of the lower flat elements 6 and 7, respectively.

The inner longer sides of the upper flat elements 3 and 4 designated by numerals 3*b* and 4*b* are connected by hinges 8 to the corresponding inner longer sides of the two lower flat elements 6 and 7.

The assembly of flat elements is supported by a pair of essentially M-shaped bearing members each comprising two vertical legs 9 integral with two slanting braces 10 and 11 forming a "V" the apex of which rests preferably but not necessarily on the floor through a base 12. Both slanting braces 10 and 11 are inside provided with a groove acting as an inner guide 13 eccentrically placed into the portion inwardly facing the "V" and leading at its upper end to a widened portion 15 having a shaped bottom 16 for example in the form of a step or the like.

An arm 17 supporting the bearing surface 1 slides into each inner guide 13.

The lower end 18 of said arm 17 is complementary shaped as the bottom 16 of the widened portion 15 of the inner guide 13, while the upper end thereof ends in a horizontal bracket 19 integral with the lower surface of the lower flat elements 6 and 7.

Figure 3:
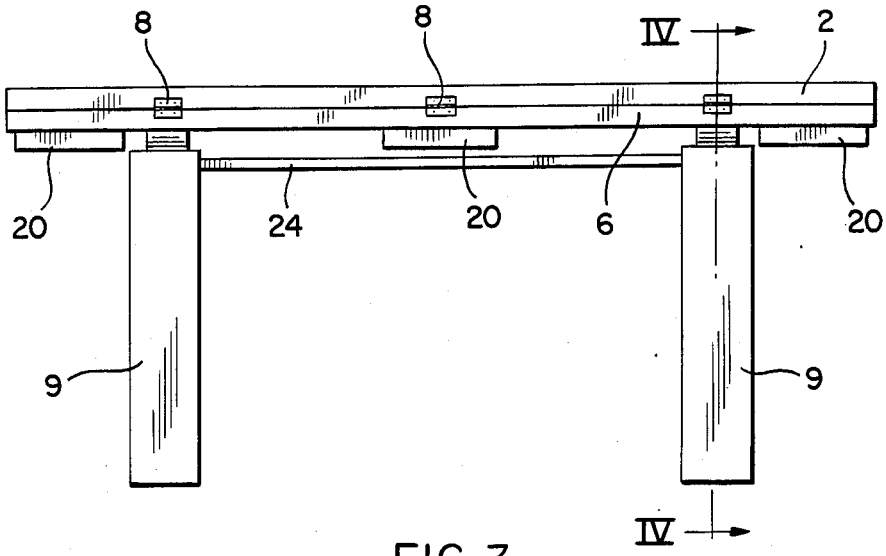
FIG. 3 is a side view of the table in closed condition.
Figure 4:
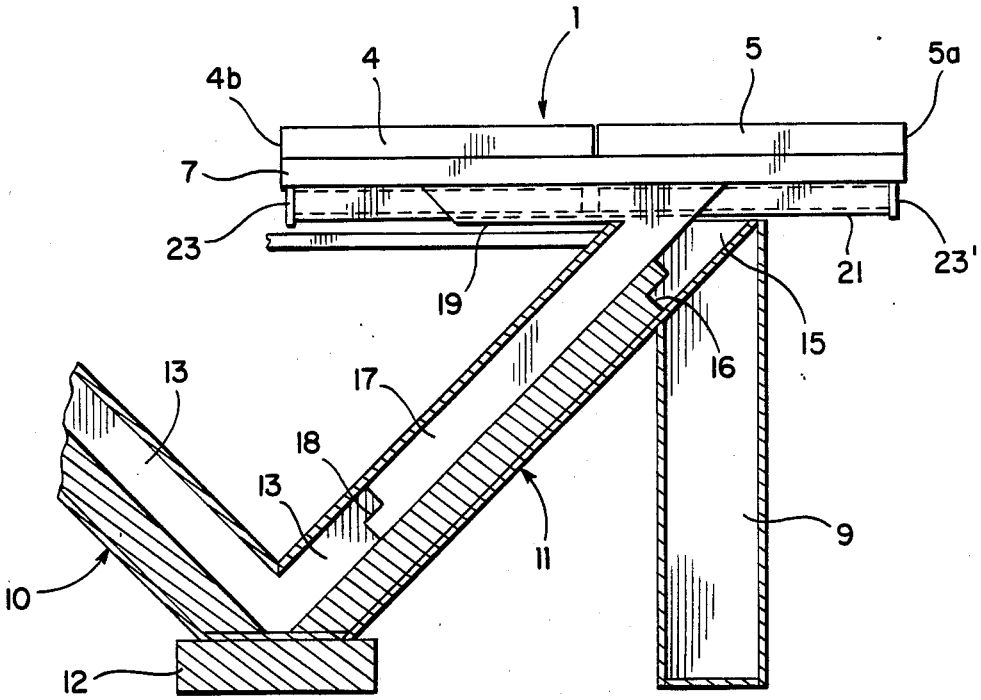
FIG. 4 is a partially sectioned view taken along the line IV—IV of FIG. 3.

Pairs of stiffening members 20, 21 are provided under the lower flat elements 6 and 7 and are placed crosswise to the flat elements and aligned to each other, for example in a number of three as shown in FIG. 3. Said stiffening members are provided inside with supporting extension means 22, 22' and 23, 23' respectively which can be telescopically extended in opposite directions for supporting the upper flat elements 2 to 5 when the latter are suitably turned over about the respective hinges 8 thus providing a bearing surface which is solid, steady and safe.

In alternative, in order to support the upper flat elements when they are turned over and aligned to the lower flat elements, the invention provides according to a variant not shown that the horizontal brackets 19 supporting the bearing surface 1 are suitably hollow to contain the supporting means telescopically extensible in opposite directions.

Stiffening cross-arms 24 parallel to the sides of the table are provided according to the invention between the slanting braces 10, 11 and between the M-shaped members.

Figure 5:
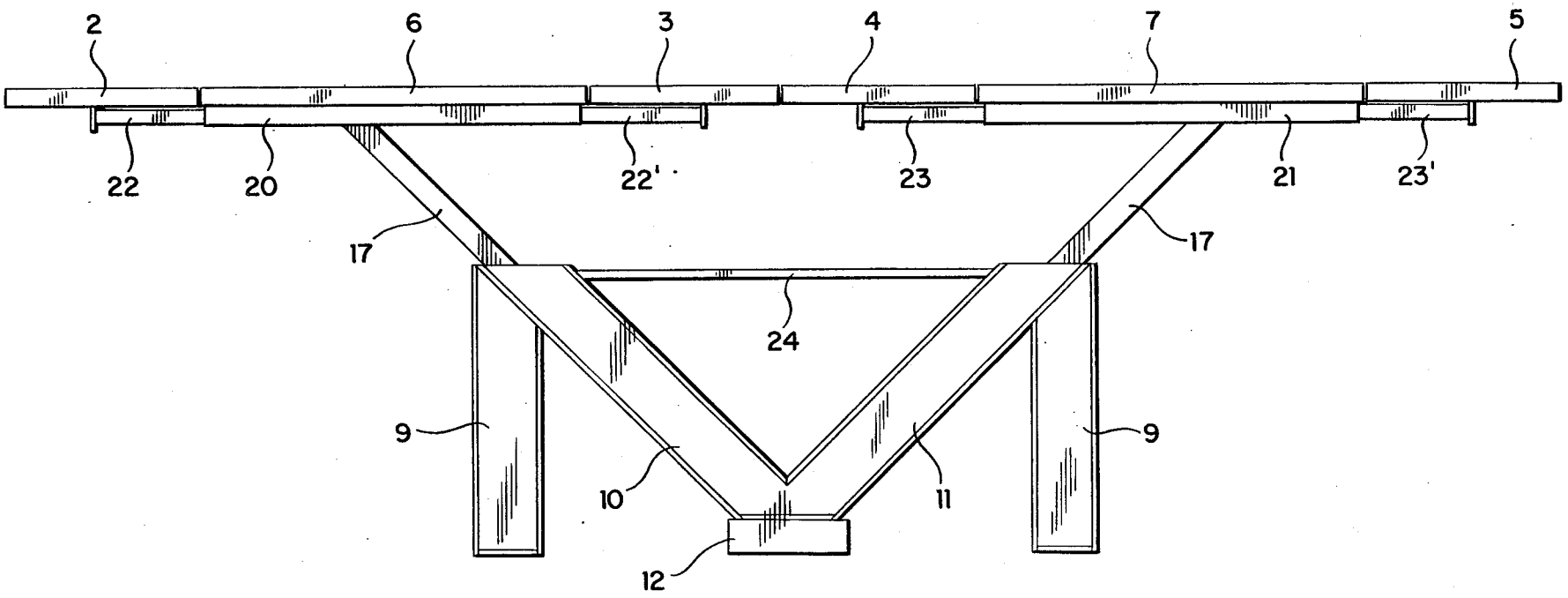
FIG. 5 is a front view of the table in opened condition to be used, for example, as a dining table.
Figure 6:
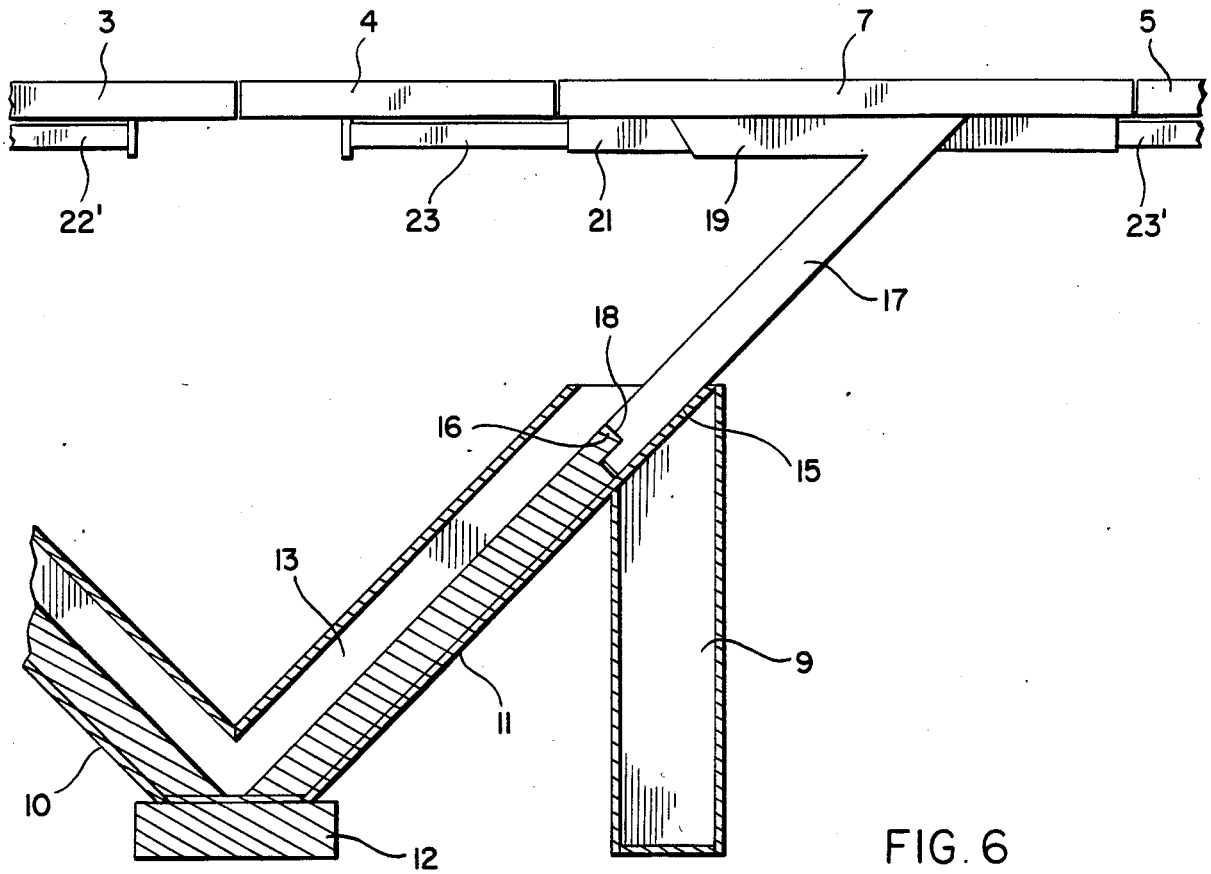
FIG. 6 is a partially sectioned view of the table of FIG. 5.
Figure 7:
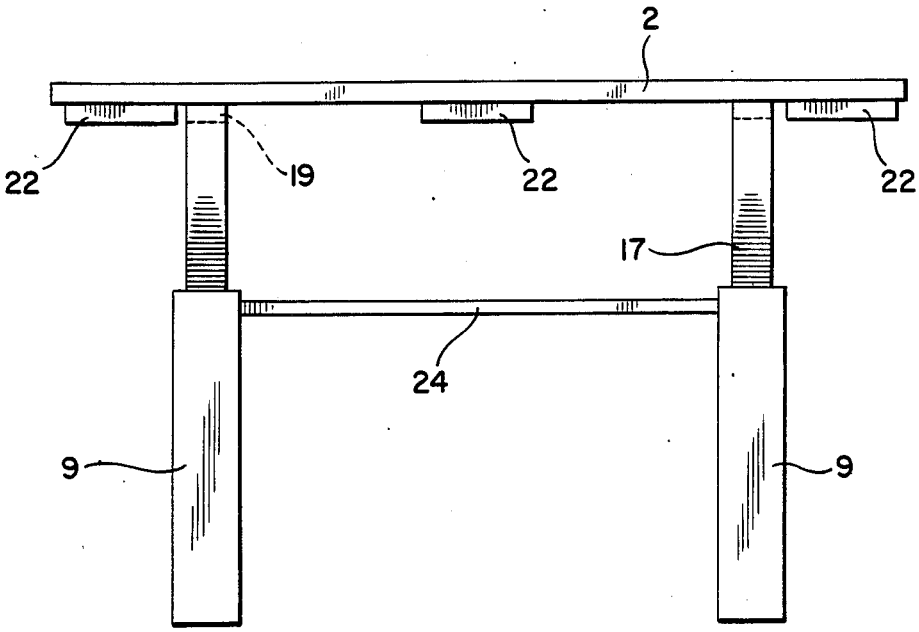
FIG. 7 is a side view of the table of FIG. 5.

In order to transform the low drawing-room table for example into a dining table, the following operations have to be carried out with reference to FIGS. 5 to 7.

Referring in particular to FIG. 6, the portion of bearing surfce 1 formed, for example, by the upper flat elements 4 and 5 overlapping the lower flat element 7 is raised till each supporting arm 17 sliding into the inner guide 13 of the respective slanting brace 11 reaches the widened portion 15 and moves towards the solid portion of the slanting brace 11 itself so that its shaped lower end 18 engages with the corresponding shaped bottom 16 of said widened portion 15. Each arm 17 is thus locked in the raised position in that it neither can shift downwards because of the engagement of the shapings 16 and 18 with each other nor turn over outwards because of the bearing contact against the lower wall of the widened portion 15 sustained by the corresponding vertical leg 9.

The length of the arms 17 will be such that the sliding of the arms themselves upwards in the oblique direction allowing the lower flat element 7 and the overlapped upper flat elements 4, 5 to be raised causes a lateral shift of said flat elements outwards to an extent corresponding to the width of an upper flat element.

The supporting extension means 23, 23' are then telescopically drawn out in opposite directions. In the shown embodiment, the stiffening means 21 containing said extension means are placed under as well as crosswise to the lower flat element 7 along the middle axis thereof and outside the legs 9.

The upper flat elements 4 and 5 are then turned over about the respective hinges 8 connecting them with the lower flat element 7 till they come into contact with the telescopic extension means 23, 23' so that said flat elements 4 and 5 are aligned with the flat element 7 to form a half raised and widened table.

The same operations are carried out in connection with the half of the table comprising the upper flat elements 2 and 3 overlapped and hinged to the lower flat element 6. The pair of arms 17 sliding into the inner guides 13 of each slanting brace 10 as well as the telescopic supporting extension means 22, 22' of the stiffening means 20 are drawn out and the upper flat elements 2 and 3 are then turned over till they come into contact with the supporting extension means 22, 22'.

By such operations carried out with the two halves of the table, a sole widened surface raised at a suitable height from the floor is provided to be used in spread out position for example as a dining table.

It is obvious that the low drawing-room table is obtained again by acting in the opposite way, just causing the arms 17 to slide lightly upwards in order to disengage their shaped ends 18 from the shaped bottoms 16 of the widened portions 15 of the inner guides 13 received in the slanting braces 10 and 11.

Different conversions of the low drawing-room table of the invention can be provided by different operations.

In particular, for example, a low drawing-room table with widened surface and raised central portion is provided if only the two upper flat elements 2 and 5 are turned over.

An ornamental table with two surfaces at different levels is provided if only one lower flat element, for example that designated by 7, is raised without turning over the respective upper flat elements 4 and 5. If the upper inner flat element 4 is further turned over, a writing-desk with associated seat is provided, the bearing surface being further extensible by turning over the upper flat element 5.

It has to be mentioned that the invention has been described and illustrated with reference to a particular embodiment thereof. However, many modifications can be made to the table of the invention, in particular regarding the form, the number and the dimensions of the flat elements, without parting from the scope of protection. The flat elements can be, for example, square and the upper flat elements can also have different widths from each other and be in a number other than four provided that the whole surface of the upper flat elements is equal to the whole surface of the lower flat elements and that the lower flat elements are moved away from each other because of the inclined raising of the sliding arms to an extent equal to the width of the upper inner flat elements to be turned over.

Furthermore, the M-shaped bearing members can assume a different form provided that they are equipped with the slanting braces forming a "V" and comprising the respective inner sliding arms. For example, the members supporting the bearing surface can be formed by simple V-shaped members the apexes of which are suitably connected to assure the stability by means of a perimetrical basis, or the V-shaped slanting braces can be built in or covered by panels connected to one another to provide a box-like member supporting the bearing surface.

According to a further embodiment of the invention, the table could be formed by only one lower flat element to which upper flat elements that can be overturned are overlapped. Such an assembly is supported at each of the opposite ends by an inclined brace provided with the respective sliding arm and resting on the floor, for stability reasons, by means of a suitable ballasted base, thus giving rise to a low drawing-room table with reduced dimensions and bearing surface, which can be raised and widened to provide, for example, a dining table.

It should be finally understood that many further modifications can be made to the low transformable drawing-room table of the invention as described and illustrated with reference in particular to the materials employed, the dimensions, the adding of possible connecting and fastening means between the turned over flat elements (particularly between the upper inner, turned over, flat elements) and other stiffening and supporting means of the bearing surface without parting from the scope of protection of the present invention.

What is claimed is:

1. A transformable low drawing-room table comprising four upper flat rectangular, side by side arranged, elements which are equal to one another in length and width, two lower flat rectangular, side by side arranged elements which are equal to each other in length and width and have the same length as the upper flat elements while being each twice the width of one of said four upper flat elements, said four upper flat elements overlap said two lower flat elements, outer elements of said upper flat elements being hinged to said lower flat elements along outer sides, inner elements of said upper flat elements being hinged to said lower flat elements along inner sides, and a pair of independently height adjustable supporting means each supporting two of said four upper elements and one of said two lower elements and each including two central slanting braces forming a "V", each slanting brace includes a groove defining an inner guide a sliding arm guided within said inner guide, an upper end of said sliding arm being integral with a horizontal bracket supporting one of said two said lower elements, locking means for locking each sliding arm in a raised position, and the length of said sliding arm being such that the movement of said sliding arm in an inclined direction causes said sliding arm to be locked and a sideward and outward shift of said lower flat element supported by said arm is allowed to extend to an extent corresponding to the width of an upper flat element.

2. A table according to claim 1, wherein each inner guide of said slanting brace is eccentrically disposed in the brace portion facing inwardly with respect to the "V" and is provided adjacent to the respective vertical leg with a widened portion having a shaped bottom, while the lower end of the sliding arm is provided with a portion having a shape complementary to the bottom of said widened portion so as to define said locking means and provide, by reciprocal engagement, locking each arm in the raised position.

3. A table according to claim 2, wherein the complementary shapes of the arm and the bottom of the widened portion of the inner guide of the slanting brace are in the form of a step.

4. A table according to claim 1, wherein stiffening means comprising telescopic extension means are provided under and crosswise to the lower flat elements, said extension means being extensible in opposite directions and supporting the upper flat elements when the upper flat elements are turned over about respective hinges connecting the upper flat elements to the lower flat elements.

5. A table according to claim 4, wherein the table is transformed into a high table when one of the two lower flat elements is raised and the respective upper flat elements overlapped thereto, thus causing the corresponding supporting arms to slide into the inner guides of the slanting braces till said arms are locked by the locking means, the telescopic extension means is withdrawn for supporting the stiffening means, the upper flat elements are turned over about the respective hinges till they come into contact with the telescopic supporting extension means, the other lower flat element is raised to provide a solid and safe table with a raised and widened bearing surface.

6. A table according to claim 4, wherein the table is transformable into a low drawing-room table with widened bearing surface and a raised central surface by turning over the two upper outer flat elements.

7. A table according to claim 4, wherein the table is transformable into a piece of furniture having two bearing surfaces at different levels by raising only one half of the table by raising one of the supporting means.

8. A table according to claim 4, wherein the table is transformable into a writing-desk with associated seat by raising only one half of the table by raising one of the supporting means and by turning over the upper inner flat element of the raised half table, such a writing-desk being extensible by turning over the upper outer flat element of said raised half table.

9. A table according to claim 4, wherein said slanting braces rest on the floor by means of a ballasted base.

10. A table according to claim 1, wherein the horizontal brackets are integral with the upper end of the arms sliding into the slanting braces and are hollow so as to contain means able to be telescopically extended in opposite directions for supporting the upper flat elements when the upper flat elements are turned over about respective hinges connecting the upper flat elements to the lower flat elements.

* * * * *